US007146884B2

(12) United States Patent
Chaconas et al.

(10) Patent No.: US 7,146,884 B2
(45) Date of Patent: Dec. 12, 2006

(54) HIGH TORQUE OPEN END WRENCH

(75) Inventors: Peter C. Chaconas, Glyndon, MD (US); Dana L. Delaney, York, PA (US); Awad Aly Gharib, Cockeysville, MD (US)

(73) Assignee: Easco Hand Tools, Inc., Simsbury, CT (US)

( * ) Notice: Subject to any disclaimer, the term of this patent is extended or adjusted under 35 U.S.C. 154(b) by 107 days.

(21) Appl. No.: 11/178,967

(22) Filed: Jul. 11, 2005

(65) Prior Publication Data

US 2006/0011020 A1 Jan. 19, 2006

Related U.S. Application Data

(60) Provisional application No. 60/587,925, filed on Jul. 14, 2004.

(51) Int. Cl.
*B25B 13/02* (2006.01)

(52) U.S. Cl. ..... 81/119; 81/186

(58) Field of Classification Search ..... 81/119, 81/120, 121, 170, 186
See application file for complete search history.

(56) References Cited

U.S. PATENT DOCUMENTS

| | | | | |
|---|---|---|---|---|
| 463,137 | A | | 11/1891 | Carpenter |
| 574,622 | A | | 1/1897 | Olden |
| 1,138,572 | A | | 5/1915 | Kaylor |
| 2,652,735 | A | * | 9/1953 | Wilder ..... 81/119 |
| 2,671,368 | A | * | 3/1954 | Diebold ..... 81/119 |
| 3,682,024 | A | | 8/1972 | Myers ..... 81/129 |
| 3,757,614 | A | | 9/1973 | Evans et al. ..... 81/119 |
| 3,921,476 | A | * | 11/1975 | Evans ..... 81/119 |
| 4,776,244 | A | | 10/1988 | Olson et al. ..... 81/119 |
| 4,889,020 | A | * | 12/1989 | Baker ..... 81/119 |
| 5,381,710 | A | * | 1/1995 | Baker ..... 81/186 |
| 5,406,868 | A | * | 4/1995 | Foster ..... 81/119 |
| 5,551,322 | A | | 9/1996 | Mikic et al. ..... 81/186 |
| 5,878,636 | A | | 3/1999 | Baker ..... 81/119 |
| 6,089,131 | A | | 7/2000 | Taimiot ..... 81/186 |
| 6,158,309 | A | | 12/2000 | Baker ..... 81/119 |
| 6,276,240 | B1 | | 8/2001 | Blacklock ..... 81/119 |
| 6,443,038 | B1 | | 9/2002 | Hsieh ..... 81/119 |

OTHER PUBLICATIONS

U.S. Appl. No. 29/209,957, filed Jul. 23, 2004.
U.S. Appl. No. 29/209,942, filed Jul. 23, 2004.

* cited by examiner

*Primary Examiner*—Lee D. Wilson
*Assistant Examiner*—Anthony Ojini
(74) *Attorney, Agent, or Firm*—Nelson Mullins Riley & Scarborough L.L.P.

(57) ABSTRACT

An open end wrench for use with a fastener having a polygonal gripping portion has an elongated body, a first jaw having a first bite surface and a second jaw having a second bite surface. The jaws form a throat therebetween having a closed end and an open end. The bite surfaces are disposed with engaging surfaces so that majority components of force vectors applied normal to the first and second bite surfaces are directed parallel to the wrench handle axis.

19 Claims, 4 Drawing Sheets

HIGH TORQUE OPEN END WRENCH

CLAIM OF PRIORITY

This application claims priority to U.S. Provisional Application No. 60/587,925, filed on Jul. 14, 2004, the entire disclosure of which is incorporated by reference herein.

BACKGROUND OF THE INVENTION

1. Field of the Invention

The present invention relates to an open end wrench and, more particularly, to an improved high torque open end wrench.

2. Description of the Related Art

An open end wrench typically has two jaws that are spaced apart to engage the flats of a fastener head and is generally used to turn and control the rotation of bolts, nuts and other fasteners. An open end wrench may be formed in a double open end, combination box end or other suitable configuration and can access fasteners under certain limited conditions where a closed end or box wrench is impractical. Open end wrenches, however, can be weaker than a box wrench due to the unsupported nature of a cantilever jaw. Reaction forces exerted on the jaws by the fastener transverse to either or both of the wrench's jaw faces cause a bending moment about the base of the jaws relative to the head. These reaction forces cause the jaws to expand as increased torque is exerted on the fastener.

There have been numerous attempts to increase the strength and torque capacity of open end wrenches, including the use of sharp teeth or serrations on the jaws or inclined and arcuate driving surfaces.

SUMMARY OF THE INVENTION

The present invention recognizes and addresses considerations of prior art constructions and methods. In one embodiment of the present invention, an open end wrench has an elongated body having a longitudinal axis extending from a first end to a second end. A first jaw extends from the body first end to a first distal end and defines a first generally planar engaging surface and a first generally planar bite surface adjacent the first engaging surface opposite the first distal end. A second jaw extends from the body first end to a second distal end and defines a second generally planar bite surface and a second generally planar engaging surface that is adjacent the second bite surface opposite the second distal end. The first jaw and the second jaw form between them a throat having a closed end and an open end opposite the closed end, where the first generally planar bite surface is disposed at a first angle with respect to the first generally planar engaging surface, the first angle extending through the first jaw and measuring less than 165 degrees and greater than or equal to 90 degrees. The second generally planar bite surface is disposed at a second angle with respect to the second generally planar engaging surface, the second angle extending through the second jaw and measuring less than 165 degrees and greater than or equal to 90 degrees, Furthermore, the first generally planar engaging surface and the second generally planar engaging surface are generally parallel to each other and to a line that intersects the body axis at a point so that a third angle is defined between a portion of the body axis extending from the point toward the body second end and a portion of the line extending from the point away from the open end of the throat. The third angle is within a range of 30 degrees to 70 degrees, and the first generally planar engaging surface and the second generally planar engaging surface are separated by a distance greater than an across-flat width of the polygonal gripping portion of the fastener.

In another embodiment of the present invention, an open end wrench for use with a fastener having a polygonal gripping portion has an elongated body having a longitudinal axis extending therethrough. A first jaw extends from the body to a first distal end and defines a first engaging surface, a first bite surface adjacent the first engaging surface opposite the first distal end, and a first bite edge between the first bite surface and the first engaging surface. A second jaw that is shorter than the first jaw, extends from the body to a second distal end and defines a second bite surface, a second engaging surface adjacent the second bite surface opposite the second distal end, and a second bite edge between the second bite surface and the second engaging surface. The first jaw and the second jaw form between them a throat having a closed end and an open end opposite the closed end. The first bite surface is disposed at a first angle with respect to the first engaging surface, the first angle extending through the first jaw and measuring less than 140 degrees and greater than or equal to 130 degrees, and the second bite surface is disposed at a second angle with respect to the second engaging surface, the second angle extending through the second jaw and measuring less than 140 degrees and greater than or equal to 130 degrees. The first engaging surface and the second engaging surface are generally parallel to each other and to a first line that intersects the body axis at a point so that a third angle is defined from a portion of the body axis extending from the point toward the elongated body and a portion of the line extending from the point away from the open end of the throat. The third angle is within a range of 30 degrees to 90 degrees, and the first engaging surface and the second engaging surface are separated by a distance greater than an across-flat width of the polygonal gripping portion of the fastener.

In yet another embodiment, An open end wrench for use with a fastener having a polygonal gripping portion has an elongated body having a longitudinal axis extending therethrough. A first jaw extends from the body to a first distal end and defines a first engaging surface, a first chamfered surface adjacent the first engaging surface proximate the jaw first distal end, where the chamfered surface is disposed at an angle relative to the first engaging surface, a first bite surface adjacent the first engaging surface opposite the jaw first distal end, and a first bite edge between the first bite surface and the first engaging surface. A second jaw that is substantially shorter in length than the first jaw extends from the body to a second distal end and defines a second bite surface, a second engaging surface adjacent the second bite surface opposite the second distal end, and a second bite edge between the second bite surface and the second engaging surface. The first jaw and the second jaw form between them a throat having a closed end and an open end opposite the closed end. The first bite surface is disposed at a first angle with respect to the first engaging surface, the first angle extending through the first jaw and measuring less than 165 degrees and greater than or equal to 90 degrees, and the second bite surface is disposed at a second angle with respect to the second engaging surface, the second angle extending through the second jaw and measuring less than 165 degrees and greater than or equal to 90 degrees. A first line intersects a center radius of the fastener that is received between the first and second jaws and the body axis at a point so that a third angle is defined between a portion of the body axis extending from the point toward the elongated body and a portion of the first line extending from the point away from the open end of the throat. The third angle is within a range of 30 degrees to 90 degrees. Additionally, the first engaging surface and the second engaging surface are separated by a distance greater than an across-flat width of the polygonal gripping portion of the fastener.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
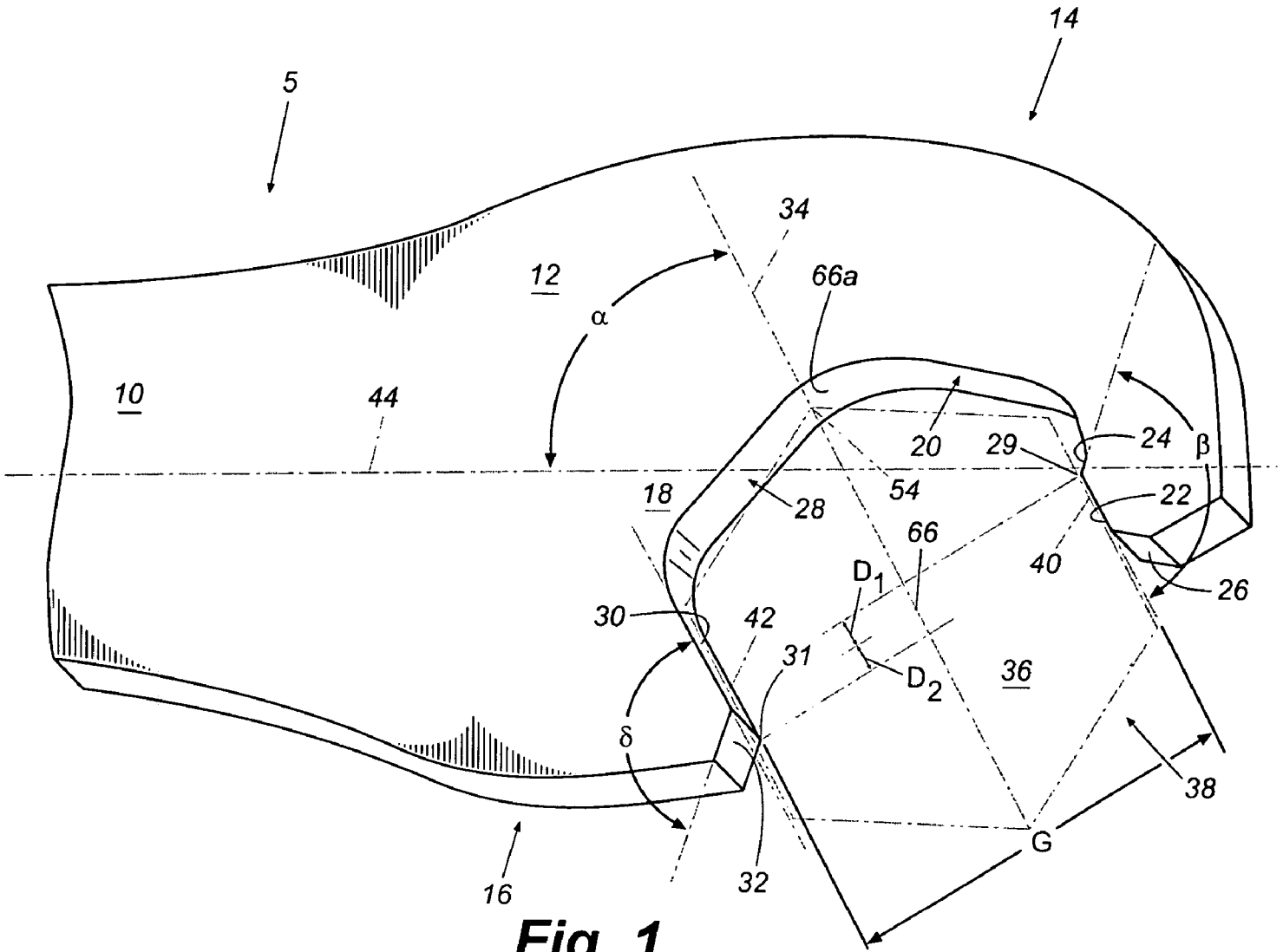
FIG. 1 is a perspective view of an embodiment of a high torque open end wrench according to the present invention.

Repeat use of reference characters in the present specification and drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. For purposes of illustration, the present invention is described with regard to a fixed jaw open end wrench, where both jaws are stationary. It should be understood, however, that an adjustable open end wrench, where one jaw is fixed and the other moveable, may also be modified according to the teachings of the present invention. Thus, it is intended that the present invention covers such modifications and variations as come within the scope of the appended claims and their equivalents.

Referring to FIG. 1, a wrench 5 includes a body having a handle 10 and a head 12 extending from one end of the handle. The head and handle may be integrally formed from a material capable of withstanding the created stresses, for example alloy steel, aluminum and various polymers. Handle 10 may be a solid piece and is generally rectangular in shape. The shape and length of handle 10 may vary depending on the application of wrench 5. Handle 10 may be, for example, generally cylindrical or polygonal in cross section. Head 12 defines a first jaw 14 extending from the wrench body to a distal end and a smaller second jaw 16 extending from the wrench body to its respective distal end. First jaw 14 and second jaw 16 are connected by a web 18. Jaws 14 and 16 may also be referred to as a following jaw and a leading jaw, respectively. That is, second jaw 16 is a leading jaw and first jaw 14 is a following jaw because the second jaw leads in the direction of rotation and the first jaw follows as the wrench rotates a fastener.

First jaw 14 defines a first receiving area 20, a first generally planar engaging surface 22 and a first generally planar bite surface 24 adjacent to one end of engaging surface 22 so that a bite edge 29 (FIG. 2B) is defined between engaging surface 22 and bite surface 24. First bite surface 24 is adjacent engaging surface 22 opposite the first jaw's distal end. Bite surface 24 is disposed at an obtuse angle β of or greater than about 90 degrees and less than about 180 degrees with respect to first engaging surface 22 (thereby defining the bite edge), with a preferred angle being about 135 degrees. A first chamfered surface 26 is defined at an opposite end of engaging surface 22 on the first jaw's distal end.

Second jaw 16 defines a second receiving area 28, a second generally planar engaging surface 30, and a second generally planar bite surface 32 adjacent one end of engaging surface 30 so that a bite edge 31 (FIG. 2B) is defined between engaging surface 30 and bite surface 32. Second bite surface 32 is disposed at an obtuse angle δ of or greater than about 90 degrees and less than about 180 degrees with respect to second engaging surface 30 (thereby defining the bite edge), with a preferred angle being about 135 degrees. Second engaging surface 30 is adjacent second bite surface 32 opposite the second jaw's distal end. It should be noted that engaging surfaces 22 and 30 and/or biting surfaces 24 and 32 may also be curved provided that the biting surface is angled with respect to its corresponding engaging surface so as to form respective biting edges 29 and 31. Second jaw 16 is substantially shorter in length than first jaw 14. More particularly, second jaw 16 is no more than one-half the length of first jaw 14 so that any bending moment exerted on second jaw 16 is substantially minimized because of the size of the jaw.

In the embodiment shown in the figures, second bite surface 32 is defined at the second jaw's distal end (although it should be understood that other configurations can be utilized) so that the second bite surface defines a chamfered surface similar to that of first chamfered surface 26. The chamfered surfaces together assist in loading a fastener between the engaging surfaces. The first and second jaws form a throat therebetween having a first closed end proximate web 18 and a second open end distal from web 18.

First engaging surface 22 and second engaging surface 30 are generally parallel to each other and to a line 34 that intersects a handle center line 44. First and second engaging surfaces 22 and 30 are spaced apart a distance G such that a head 36 of a fastener 38 fits between the engaging surfaces. More particularly, distance G is slightly greater than the across-flat distance between a first flat side 40 and an opposite second flat side 42 of fastener head 36, thereby allowing wrench head 12 to slidingly receive fastener head 36. The spacing between each head flat side and a corresponding engaging surface of the fastener is between 0.001 inches and 0.020 inches, with a preferred distance of 0.001 inches.

An angle α between line 34 and handle center line 44 is approximately sixty degrees.

Thus, wrench head 12 receives fastener head 36 at an approximately sixty degree angle with respect to handle 10. Because line 34 is parallel to first and second engaging surfaces 22 and 30, angle α describes the orientation of these surfaces with respect to handle centerline 44. Thus, as α approaches zero, jaw engaging surfaces 22 and 30 move toward becoming parallel to handle axis 44. Angle α may be in the range of 45 to 90 degrees, although preferably angle α is 60 degrees +/−2 degrees.

Figure 2A:
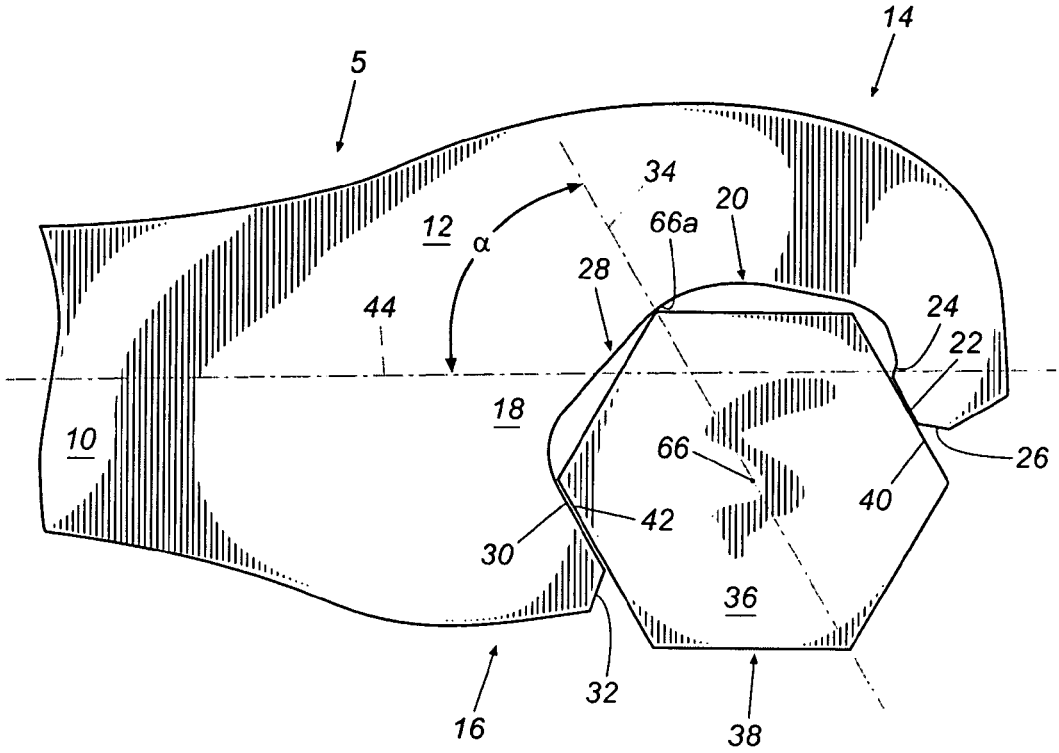
FIGS. 2A–2D are plan views of the high torque open end wrench of FIG. 1 operating on a fastener.
Figure 2B:
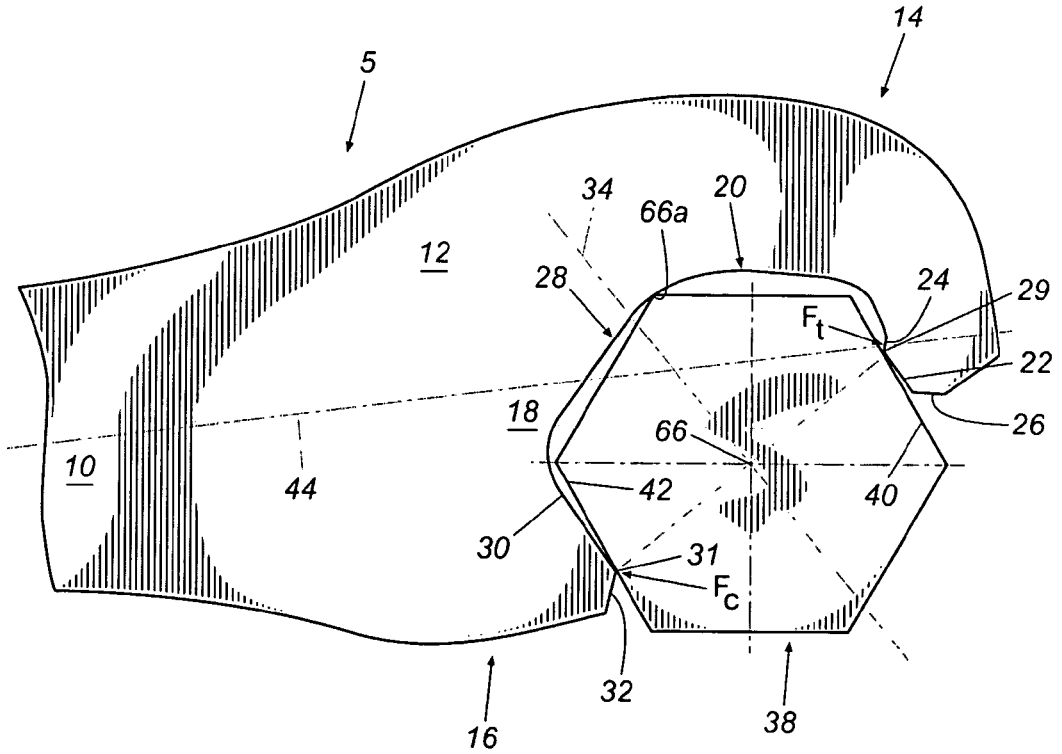

In operation, and referring to FIG. 2A, fastener 38 is slidingly received between jaws 14 and 16 adjacent to first and second engaging surfaces 22 and 30. The wrench is positioned about fastener 38 such that at least one corner of fastener head 36 abuts a radius 66*a* between receiving areas 20 and 28 at a point on line 34. Sufficient clearance is provided by the wall of area 20 and by first bite surface 24 so that the wrench head does not apply torque to the fastener corner 50 (FIG. 2C) immediately counterclockwise (from the perspective shown in FIG. 2C) of the wall and the first bite surface, respectively. The same holds true for the second bite surface 32 and fastener corner 52.

More specifically, and referring to FIG. 1, when fastener 38 is inserted between jaws 14 and 16, fastener corner 54 abuts radius 66*a*. In this position bite edges 29 and 31 are spaced a distance D1 and D2, respectively, from the center point of radius 66 of fastener head 38. In a preferred embodiment, D1 and D2 are equal in length but on opposite sides of center point radius 66 measured parallel to line 34. D1 and D2 are preferably 0.05 inches in length for a 9/16 inch fastener but are scalable for different sized fastener heads, as shown in the table below.

| Hex Size | D1/D2 |
|---|---|
| 7/16 | 0.039/0.039 |
| 1/2 | 0.044/0.044 |
| 9/16 | 0.050/0.050 |
| 5/8 | 0.056/0.056 |

The spacing between bite edges 29 and 31 and fastener center radius 66 dictates the ratio of turning force applied to the fastener and spreading force applied to the jaws. That is, if D1 and D2 are zero, then the spreading force applied to the jaws is greatest since no contact moment is created between the bite edges and the fastener center radius. If, D1 and D2 is greater than zero, however, the amount of spreading force applied to the jaws is reduced due to the moment arm formed between each biting surface 29 and 31 and fastener center radius 66. Furthermore, for optimum torque loading on the fastener edges, D1 should be an equal but opposite distance from center radius 66 as D2. If the distance D1 and D2 are not equal the bite edge closest to center radius 66 will have a larger plowing affect on the fastener head than the other bite edge causing the fastener to rotate in the wrench head so that the forces exerted by each bite edge are equal. Thus, an unequal spacing of the bite edges about center radius 66 can result in damage to the fastener head through excessive plowing by the bite edge closest to center radius 66.

Figure 2C:
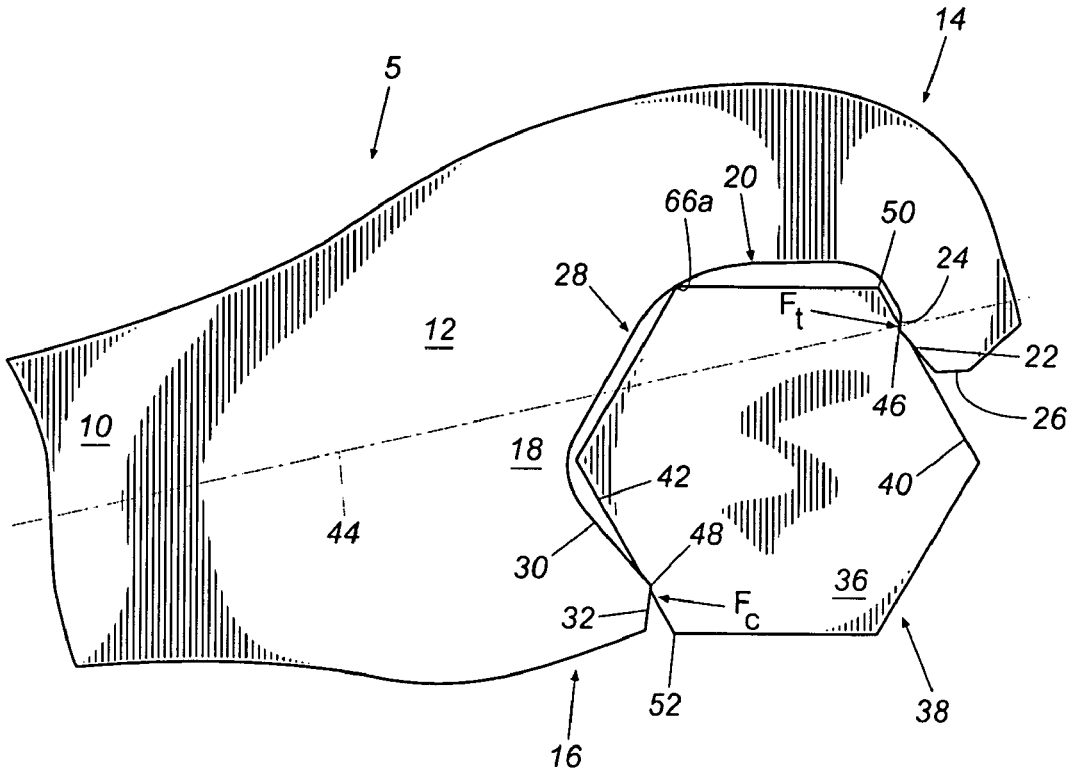

Because the distance between engaging surfaces 22 and 30 is greater than the across-flat distance between flat sides 40 and 42, the wrench head can rotate slightly in the counterclockwise direction while taking up the clearance between the bite surfaces and the fastener edges without placing any load force on the fastener head. Thus, and referring to FIGS. 2B and 2C, as wrench handle 10 rotates the head counterclockwise, first and second engaging surfaces 22 and 30, and bite surfaces 24 and 32, pivot about center radius 66 of fastener 38 so that the engaging surfaces are no longer generally parallel to fastener first and second flat sides 40 and 42 and bite edges 29 and 31 (FIG. 2B) contact the fastener sides. Consequently, as the wrench is rotated, a contact force $F_t$ is exerted on jaw 14 at bite surface 24, and a contact force $F_c$ is exerted on jaw 16 at bite surface 32. Further rotation of handle 10 as shown in FIG. 2C causes bite edges 29 and 31 to plow into their corresponding fastener flat sides 40 and 42, respectively, as the jaws apply torque to the fastener head.

"Plowing" refers to the jaw bite edges and surfaces digging into the fastener head so that fastener material builds up in front of the bite surface. This helps to retain the jaws in engagement with the fastener sides at a location sufficiently spaced from fastener corners 50 and 52 (FIG. 2D) so that the corners are not sheared off under high torque loading. The amount of plowing is a function of the angle between the biting and engaging surfaces and the hardness of the fastener material. Thus, as the hardness of the fastener material is decreased, the angle between the surfaces should be increased to minimize the amount of gouging the fastener sides are subjected to. It should be understood that in order to achieve adequate plowing, the bite edge must be sufficiently sharp. That is, because the bite edge is formed by the intersection of two generally planar surfaces, the resulting corner should be a sharp vertex to allow for sufficient plowing of the fastener material. It should be understood that while the engaging and biting surfaces have been described as being generally planar, these surfaces may also be curved provided that the apex formed between the two surfaces is sufficiently sharp to result in sufficient plowing. In a case where either the engaging or biting surfaces are curved, the angle $\beta$ and $\delta$ should be measured from a line tangent to an apex of the curved surface.

Figure 2D:
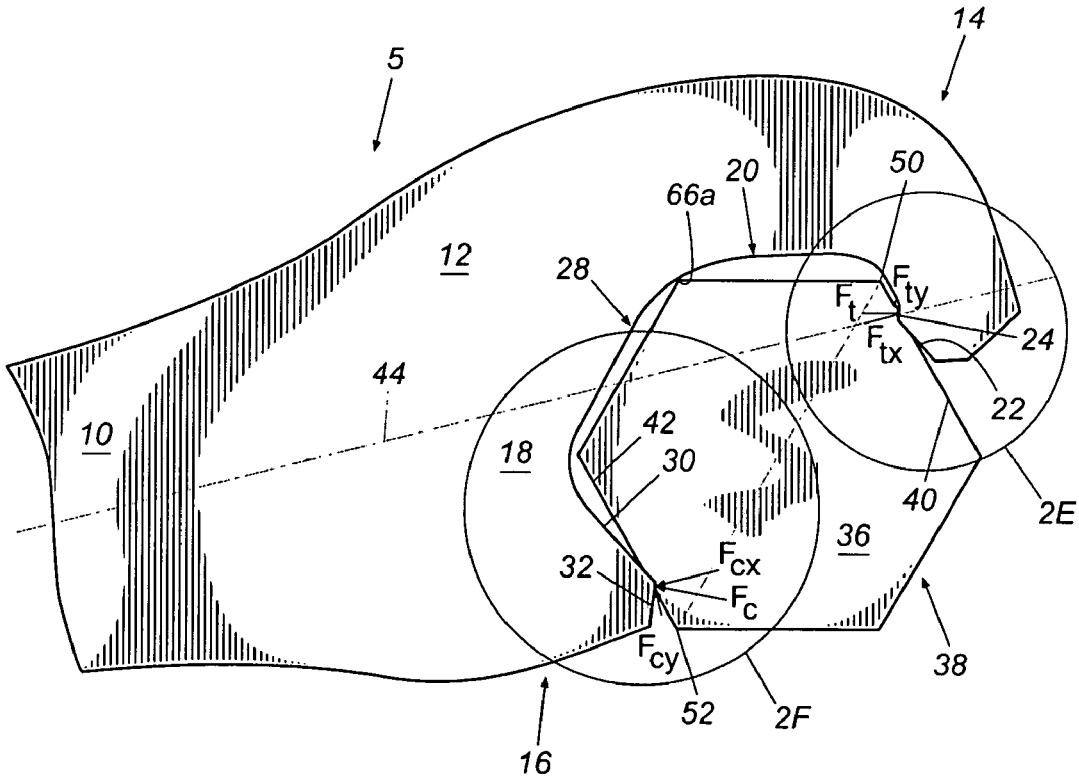
Figure 2E:
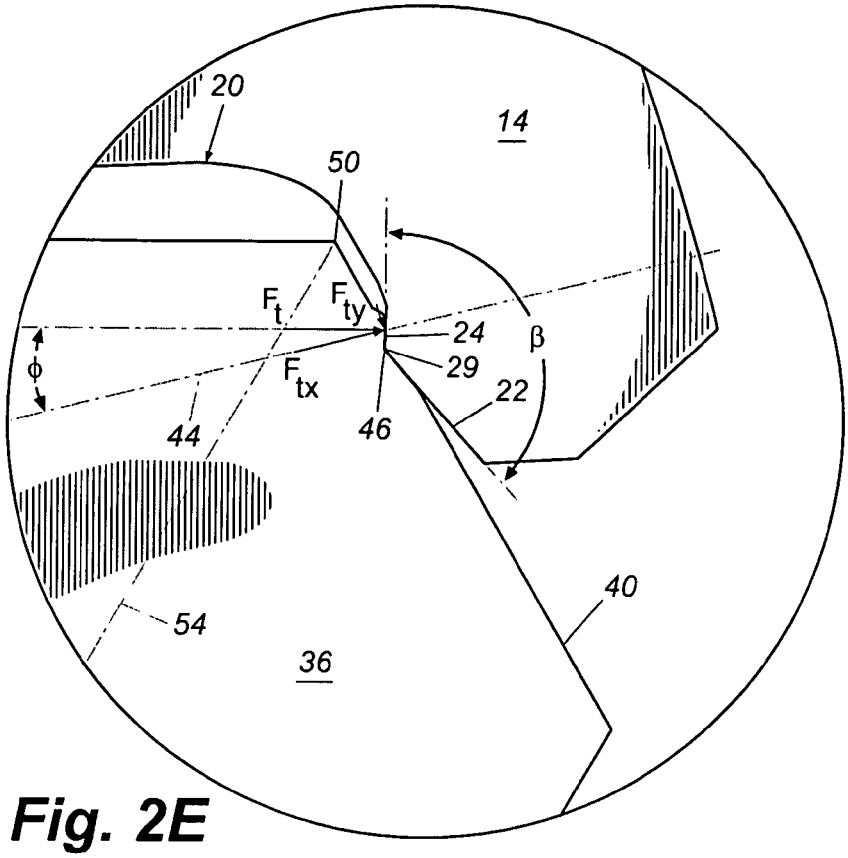
FIGS. 2E–2F are enlarged detail views of the jaws of the high torque open end wrench of FIG. 1 shown operating on a workpiece.
Figure 2F:
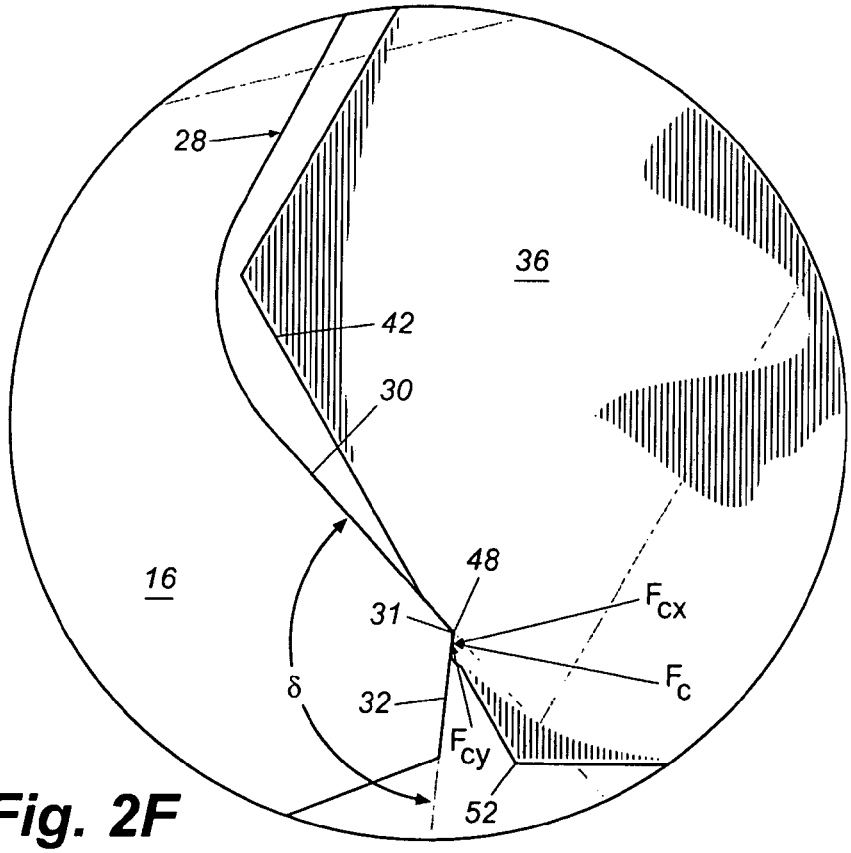

FIGS. 2D–2F provide greater detail of indentations 46 (FIG. 2E) and 48 (FIG. 2F) in fastener sides 40 and 42 as increased counterclockwise torque loading on handle 10 increases contact force $F_t$ and contact force $F_c$ and plows fastener material toward respective corners 50 and 52. Since the degree to which the wrench jaws plow into the fastener sides is a function not only of force but of material, the present discussion assumes that the wrench is made from a material, e.g. alloy steel 6140, that is harder than the fastener material, e.g. alloy steel 1035. Preferably, there is a 10 point or greater hardness differential between the wrench material and the fastener material.

As noted above, the jaws of an open end wrench are generally exposed to forces tending to spread the jaws apart when the jaws apply torque to a fastener head. To the extent these forces are perpendicular to an elongated portion of either jaw, the force creates a bending moment about the base of the elongated portion. Depending on (1) the magnitude of the force, (2) the distance between the base and the point at which the force is applied, and (3) the jaw's construction, the jaws can bend or even break at the base.

An open end wrench jaw can have a portion thereof extending generally parallel to the wrench body center line. Where the throat opens in line with the wrench body's centerline (i.e. where angle $\alpha$ in FIG. 1 is zero), a fastener side applies a significant portion of its reaction force to a jaw perpendicular to the body center line and, therefore, creates a maximum bending moment due to the relatively long distance and large effective force component applied. The throat of a wrench is defined as the area bounded by web 18 and the jaw engaging surfaces 22 and 30, and the direction of the throat opening is defined by the angle $\alpha$ between handle axis 44 and line 34 (FIG. 1).

In the embodiment of the present invention shown in FIG. 1, angle $\alpha$ is 60 degrees (preferably ±2 degrees), so that the throat is disposed at a 60 degree angle with respect to body center line 44. Thus, if the fastener were to apply a reaction force directly perpendicularly into engaging surface 22, i.e. at a 30 degree angle with respect to center line 44, the major component of the reaction force applied to first jaw 14 would be parallel to center line 44, thereby tending to put the majority of jaw 14 in tension. Although a component of the reaction force would remain perpendicular to the generally parallel portion of jaw 14, the resulting bending moment would be reduced, thereby increasing the amount of torque that could be applied to the wrench without detrimentally bending or breaking the jaw. As apparent in FIG. 2D, the distal end of jaw 14 curves from the main portion of the jaw and is generally transverse to body center line 44. Thus, the portion of contact force $F_t$ parallel to center line 44 creates a bending moment at the jaw's end. The distal end is relatively short, however, and the bending moment therefore does not significantly impair the wrench's performance.

The present embodiment's 60 degree disposition minimizes the length of second jaw 16, thereby decreasing the bending moment that the fastener's reaction force applies to the jaw. Thus, if a reaction force were to be applied directly perpendicularly to engaging surface 30, most of the resulting reaction force would tend to put jaw 16 in compression. Although a component of the reaction force would remain perpendicular to center line 44, the resulting bending moment would be reduced, thereby increasing the amount of torque that could be applied to the wrench without detrimentally bending or breaking the jaw.

As discussed above, however, the difference between the fastener's across-flat dimension, the distance between parallel engaging surfaces 22 and 30, and contact stresses created by the resistance of the fastener allow bite edges 29 and 31 (FIG. 2B) to plow into the fastener sides so that bite surfaces 24 and 32 apply torque to the fastener head through the built up material in front of the bite surfaces. Thus, while the fastener's reaction forces $F_t$ and $F_c$ are applied to bite surfaces 24 and 32 in combination with engaging surfaces 22 and 30, respectively, the majority of the reaction forces are directly received perpendicular to bite surfaces 24 and 32, as shown in FIGS. 2E and 2F, and not to the engaging surfaces 22 and 30.

In a preferred embodiment, each of forces $F_t$ and $F_c$ is at the same angle $\phi$ on either side of center line 44 (shown in FIG. 2E only with respect to force $F_t$) with respect to lines parallel to body center line 44 that is determined by (1) throat angle $\alpha$, (2) included angles $\beta$ and $\delta$ at which bite surfaces 24 and 32 are disposed with respect to engaging surfaces 22 and 30, respectively, and (3) the degree to which the engaging surfaces and bite surfaces pivot about fastener center radius 66 as bite surfaces 24 and 32 plow into respective fastener sides 40 and 42.

In one embodiment with a throat angle of sixty degrees, included angles $\beta$ and $\delta$ are preferably 135 degrees (preferably ±2 degrees). Accordingly, to the extent to which the engaging and biting surfaces pivot about fastener center radius 66, each angle $\phi$ is preferably equal to or in excess of about 15 degrees and less than about 30 degrees to maintain sufficient plowing of bite edges 29 and 31 into the fastener sides. It should be understood that the angle $\phi$ for each force vector does not have to be the same in a given wrench design. That is, the angle $\phi$ for each bite surface may be adjusted accordingly by varying the angles $\beta$ or $\delta$ to maximize the force component parallel to the wrench axis while also maximizing the plowing effect on the fastener edges. Consequently, the angle $\phi$ is a function of the angles $\alpha$, $\beta$, and $\delta$.

FIGS. 2D–2F illustrate contact reaction forces $F_t$ and $F_c$ and their components parallel to ($F_{tx}$ and $F_{cx}$) and perpendicular to ($F_{ty}$ and $F_{cy}$) body center line 44. For purposes of clarity, the component arrow magnitudes are not drawn to scale. Because angle $\phi$ is preferably smaller than the approximately 30 degrees at which the contact reaction forces would be disposed with respect to the body center line if the reaction forces were applied directly perpendicular to engagement surfaces 22 and 30, an even greater portion ($F_{tx}$ and $F_{cx}$) of the reaction forces $F_t$ and $F_c$ are parallel to the body center line, thereby increasing the amount of torque that could be applied to the wrench without detrimentally bending or breaking the jaw.

As should be apparent, angle $\alpha$ and/or angles $\beta$ and $\delta$ can be adjusted to further increase or decrease angle $\phi$, even to approximately zero degrees. The choice of any given set of angles can depend, for example, on the materials used for the wrench, the expected fastener materials and limitations, if any, on the angle at which it is desired for the wrench to approach and attach to the fastener. The first two factors influence the depth to which the bite edges will plow into the fastener sides and, therefore, the amount of fastener material that builds in front of the bite surfaces and the degree to which the jaws pivot about fastener center radius 66 before plowing begins. Where a fastener is made from a material much softer than that of the wrench jaws, sharper bite edges (i.e. smaller angles $\beta$ and $\delta$) may plow too deep into the fastener and undesirably gouge its sides.

The attachment angle (i.e. the throat angle $\alpha$) of a particular wrench design can be affected by the environment in which it is expected the wrench will be used. For very tight areas, for example, it may be desirable to decrease the throat angle so that the throat more closely aligns with the wrench body center line. Generally, one desirable range for throat angle $\alpha$ that permits effective use of the wrench in commercial and do-it-yourself environments is in the range of 40 to 60 degrees. Given this range, and assuming the wrench jaws are made of alloy steel and the fastener head is made of carbon steel, one desirable range for angle $\beta$ and $\delta$ is 130 to 140 degrees. Generally, it is desirable that angle $\phi$ be greater than or equal to 15 degrees, with a preferred range being greater than 20 degrees and less 30 degrees, as described above.

As noted above, bite edges 29 and 31 preferably engage the fastener edges within a range of ⅙ to ¼ the distance from respective corners 50 and 52 to the midpoints of their corresponding fastener sides to reduce the likelihood that the wrench jaws will shear the fastener corners. Further in this regard, the wall of first receiving area 20 should be sufficiently deep that corner 50 does not engage the wall after bite edge 29 digs into the fastener side allowing the wrench to rotate slightly with respect to the fastener head as bite edges 29 and 31 plow into the fastener material.

The plowing of bite edges 29 and 31 into the fastener sides, and the resulting application of torque to the fastener through bite surfaces 24 and 32, increases the amount of torque that can be applied to the fastener. As should be understood in this art, when a force is applied to the side of a fastener that rotates about its center radius 66, the component of that force that applies torque to the fastener is that which is perpendicular to a radius extending from the fastener's center point to the point at which the force is applied to the fastener side. As is apparent from FIG. 1, the forces applied by bite surfaces 24 and 32 (i.e. the forces opposing contact forces $F_t$ and $F_c$) are closer to perpendicular to such a radius than those forces otherwise would be if applied directly perpendicular to the hexagonal fastener sides. Thus, the embodiment of the present invention shown in the figures provides both a stronger and a more effective open end wrench.

It should be appreciated by those skilled in the art that various modifications and variations can be made in the present invention without departing from the scope and spirit of the invention. It is intended that the present invention cover such modifications and variations as come within the scope and spirit of the appended claims and their equivalents.

What is claimed is:

1. An open end wrench for use with a fastener having a polygonal gripping portion, the wrench comprising:

a. an elongated body having a longitudinal axis extending from a first end to a second end;

b. a leading jaw extending from the body first end to a first distal end and defining a first generally planar bite surface, and a first generally planar engaging surface adjacent the first bite surface opposite the first distal end; and c. a following jaw extending from the body first end to a second distal end and defining, a second generally planar engaging surface, and a second generally planar bite surface adjacent the second engaging surface opposite the second distal end;

wherein the leading jaw and the following jaw form between them a throat having a closed end and an open end opposite the closed end, wherein the first generally planar bite surface is disposed at a first angle with respect to the first generally planar engaging surface, the first angle extending through the leading jaw and measuring less than about 165 degrees and greater than or equal to about 90 degrees, wherein the second generally planar bite surface is disposed at a second angle with respect to the second generally planar engaging surface, the second angle extending through the following jaw and measuring less than about 165 degrees and greater than or equal to about 90 degrees, wherein a first line intersects a center of the polygonal gripping portion received between the first and second generally planar engaging surfaces and the longitudinal body axis at a point so that a third angle is defined between a portion of the body axis extending from the point toward the elongated body and a portion of the first line extending from the point away from the open end of the throat, wherein the third angle is within a range of about 30 to 70 degrees, and wherein the first angle, second angle and third angle are defined so that a second line perpendicular to the first bite surface is disposed at an angle greater than or equal to about 15 degrees and less than or equal to about 30 degrees with respect to the body axis, and a third line perpendicular to the second bite surface is disposed at an angle greater than or equal to about 15 degrees and less than or equal to about 30 degrees with respect to the body axis.

2. The open end wrench as in claim 1, wherein the first generally planar engaging surface and the first generally planar bite surface define a first bite edge therebetween, and wherein the second generally planar engaging surface and the second generally planar bite surface define a second bite edge therebetween, wherein the bite edges are of sufficient sharpness to plow into the fastener sides.

3. The open end wrench as in claim 2, wherein the closed end of the throat defines an area that receives the polygonal gripping portion of the fastener so that, when the first bite edge engages a first flat side of the polygonal gripping portion and the second bite edge engages a second flat side of the polygonal gripping portion, the area receives a first corner of the polygonal gripping portion at an end of the first flat side without engagement of a wall of the area with the first corner and receives a second corner of the polygonal gripping portion at an end of the second flat side without engagement of a wall of the area with the second corner.

4. The open end wrench as in claim 1, wherein each of the first angle and the second angle is about 135 degrees.

5. The open end wrench as in claim 4, wherein the third angle is about 60 degrees.

6. An open end wrench for use with a fastener having a polygonal gripping portion, the wrench comprising:

a. an elongated body having a longitudinal axis extending therethrough;

b. a leading jaw extending from the elongated body to a first distal end and defining a first bite surface, a first engaging surface adjacent the first bite surface opposite the first distal end, and a first bite edge between the first bite surface and the first engaging surface; and c. a following jaw that is larger than the leading jaw and that extends from the elongated body to a second distal end and defines, a second engaging surface that is generally parallel to the first engaging surface, a second bite surface adjacent the second engaging surface opposite the second distal end, and a second bite edge between the second bite surface and the second engaging surface;

wherein the leading jaw and the following jaw form between them a throat having a closed end and an open end opposite the closed end, wherein the first bite surface is disposed at a first angle with respect to the first engaging surface, the first angle extending through the leading jaw and measuring less than about 165 degrees and greater than or equal to about 90 degrees, wherein the second bite surface is disposed at a second angle with respect to the second engaging surface, the second angle extending through the following jaw and measuring less than about 165 degrees and greater than or equal to about 90 degrees, wherein a first line intersects a center of the polygonal gripping portion received between the first and second engaging surfaces and the longitudinal body axis at a point so that a third angle is defined between a portion of the longitudinal body axis extending from the point toward the elongated body and a portion of the first line extending from the point away from the open end of the throat, wherein the third angle is within a range of about 30 to 70 degrees, wherein the first engaging surface and the second engaging surface are separated by a distance greater than an across-flat width of the polygonal gripping portion of the fastener, and wherein the first angle, second angle and third angle are defined so that a second line perpendicular to the first bite surface is disposed at an angle greater than or equal to about 15 degrees and less than or equal to about 30 degrees with respect to the longitudinal body axis, and a third line perpendicular to the second bite surface is disposed at an angle greater than or equal to about 15 degrees and less than or equal to about 30 degrees with respect to the longitudinal body axis.

7. The open end wrench as in claim 6, wherein each of the first angle and the second angle is about 135 degrees.

8. The open end wrench as in claim 7, wherein the third angle is about 60 degrees.

9. The open end wrench as in claim 6, wherein a. a first distance from the first bite edge, measured from a fourth line that is perpendicular to the first line and intersecting the first bite edge, and the center of the polygonal gripping portion, and b. a second distance from the second bite edge, measured from a fifth line that is perpendicular to the first line and intersecting the second bite edge, and the center of the polygonal gripping portion are equal in length.

10. An open end wrench for use with a fastener having a polygonal gripping portion, the wrench comprising:

a. an elongated body having a longitudinal axis extending therethrough;

b. a leading jaw extending from the elongated body to a first distal end and defining a first bite surface, and a first engaging surface adjacent the first bite surface opposite the first distal end, a first bite edge between the first bite surface and the first engaging surface; and c. a following jaw larger than the leading jaw and extending from the elongated body to a second distal end and defining, a second engaging surface, a second bite surface adjacent the second engaging surface opposite the second distal end, and a second bite edge between the second bite surface and the second engaging surface;

wherein the leading jaw and the following jaw form between them a throat having a closed end and an open end opposite the closed end, wherein the first bite surface is disposed at a first angle with respect to the first engaging surface, the first angle extending through the leading jaw, wherein the second bite surface is disposed at a second angle with respect to the second engaging surface, the second angle extending through the following jaw, wherein a first line intersects a center of the polygonal gripping portion received between the first and second engaging surfaces and the longitudinal body axis at a point so that a third angle is defined between a portion of the longitudinal body axis extending from the point toward the elongated body and a portion of the first line extending from the point away from the open end of the throat, and wherein the first angle, second angle and third angle are defined so that a second line perpendicular to the first bite surface is disposed at an angle greater than 15 degrees with respect to the longitudinal body axis, and a third line perpendicular to the second bite surface is disposed at an angle greater than 15 degrees with respect to the longitudinal body axis.

11. The open end wrench as in claim 10, wherein each of the first angle and the second angle is about 135 degrees.

12. The open end wrench as in claim 10, wherein the third angle is about 60 degrees.

13. The open end wrench as in claim 10, wherein a. a first distance from the first bite edge, measured from a fourth line that is perpendicular to the first line and intersecting the first bite edge, and the center of the polygonal gripping portion, and b. a second distance from the second bite edge, measured from a fifth line that is perpendicular to the first line and intersecting the second bite edge, and the center of the polygonal gripping portion are equal in length.

14. An open end wrench for use with a fastener having a polygonal gripping portion, the wrench comprising:

a. an elongated body having a longitudinal axis extending from a first end to a second end;

b. a leading jaw extending from the body first end to a first distal end and defining a first bite surface, a first engaging surface adjacent the first bite surface opposite the first distal end, and a first bite edge between the first engaging surface and the first bite surface defined by a first angle between the first engaging surface and the first bite surface; and c. a following jaw extending from the body first end to a second distal end and defining, a second engaging surface, a second bite surface adjacent the second engaging surface opposite the second distal end, and a second bite edge between the second bite surface and the second engaging surface defined by a second angle between the second engaging surface and the second bite surface, wherein a first line intersects the longitudinal body axis at a point and a center of the polygonal gripping portion received between the engaging surfaces of the wrench, wherein a first distance from the first bite edge, measured from a second line that is perpendicular to the first line and intersecting the first bite edge, and the center of the polygonal gripping portion, and a second distance from the second bite edge, measured from a third line that is perpendicular to the first line and intersecting the second bite edge, and the center of the polygonal gripping portion are equal in length, and wherein a fourth line perpendicular to the first bite surface is disposed at a third angle that is greater than about 15 degrees and less than about 30 degrees with respect to the longitudinal body axis, and a fifth line perpendicular to the second bite surface is disposed at a fourth angle that is greater than about 15 degrees and less than about 30 degrees with respect to the longitudinal body axis.

15. The open end wrench as in claim 14, wherein the leading jaw and the following jaw form between them a throat having a closed end and an open end opposite the closed end, the first angle measures less than 165 degrees and greater than or equal to 90 degrees, the second angle measures less than 165 degrees and greater than or equal to 90 degrees, a fifth angle is defined from a portion of the longitudinal body axis extending from the point toward the body second end and a portion of the first line extending from the polygonal gripping portion center away from the open end of the throat, and the fifth angle is within a range of 30 degrees to 70 degrees.

16. The open end wrench as in claim 15, wherein the fifth angle is approximately 60 degrees.

17. The open end wrench as in claim 14, wherein each of the first angle and the second angle is approximately 135 degrees.

18. A method of applying torque to a fastener using an open end wrench comprising:

a. providing an open end wrench having, i. an elongated body having a longitudinal axis;

ii. a leading jaw extending from the body to a first distal end and defining a first bite surface, a first engaging surface adjacent the first bite surface opposite the first distal end, and a first bite edge between the first engaging surface and the first bite surface defined by a first angle measured between the first engaging surface and the first bite surface; and iii. a following jaw extending from the body to a second distal end and defining a second engaging surface, a second bite surface adjacent the second engaging surface opposite the jaw second distal end, and a second bite edge between the second bite surface and the second engaging surface defined by a second angle measured between the second engaging surface and the second bite surface, wherein the first engaging surface and the second engaging surface are separated by a distance greater than an across-flat width of the polygonal gripping portion of the fastener;

b. placing the polygonal gripping portion between the first and second engaging surfaces such that respective engaging surfaces are adjacent opposing flat sides of the polygonal gripping portion;

c. rotating the elongated body over a limited distance with respect to and about a center of the polygonal gripping portion so that the first and second bite edges engage with and plow into respective opposite flat sides of the polygonal gripping portion such that the forces acting on the polygonal gripping portion are normal to the first and second biting surfaces, and the force vector normal to the first and second bite surfaces are disposed at an angle greater than about 15 degrees and less than about 30 degrees with respect to the body axis.

19. The open end wrench as in claim 18, wherein the leading jaw and the following jaw form between them a throat having a closed end and an open end opposite the closed end, a first line intersects the longitudinal body axis at a point and a center of the polygonal gripping portion received between the engaging surfaces of the wrench, the first angle measures less than about 165 degrees and greater than or equal to about 90 degrees, the second angle measures less than about 165 degrees and greater than or equal to about 90 degrees, a third angle is defined from a portion of the longitudinal body axis extending from the point toward the body and a portion of the first line extending from the polygonal gripping portion center away from the open end of the throat, and the third angle is within a range of 30 degrees to 70 degrees.

* * * * *